US005329080A

United States Patent [19]

Pierce et al.

[11] Patent Number: 5,329,080

[45] Date of Patent: Jul. 12, 1994

[54] PUSHBUTTON SELECTOR SWITCH

[75] Inventors: Anthony E. Pierce, Glasgow; William S. Ferguson, Russellville; Darrell W. Sullivan, Bowling Green, all of Ky.

[73] Assignee: Eaton Corporation, Cleveland, Ohio

[21] Appl. No.: 52,443

[22] Filed: Apr. 23, 1993

[51] Int. Cl.[5] ..... H01H 9/20

[52] U.S. Cl. ..... 200/5 B; 200/5 E; 200/50 C

[58] Field of Search ..... 200/5 B, 5 C, 5 D, 5 E, 200/5 EA, 5 EB, 50 C, 328

[56] References Cited

U.S. PATENT DOCUMENTS

| | | | |
|---|---|---|---|
| 3,478,179 | 11/1969 | Hanson et al. | 200/5 E |
| 3,560,677 | 2/1971 | Kolb | 200/50 C |
| 4,392,029 | 7/1983 | Schaad et al. | 200/5 B |
| 4,447,688 | 5/1984 | Schaad et al. | 200/531 |
| 4,544,810 | 10/1985 | Butterworth | 200/5 B |
| 4,701,578 | 10/1987 | Keranen et al. | 200/5 B |

*Primary Examiner*—J. R. Scott

*Attorney, Agent, or Firm*—Larry G. Vande Zande

[57] ABSTRACT

A pair of pushbuttons on opposite sides of a release pushbutton are individually depressible to operate a respective set of normally open contacts to a closed position. A rotatably mounted latch is spring biased against a medial surface of one of the pair of pushbuttons to engage a latch surface upon depression sufficient to close the contacts. The release pushbutton overlies a lever arm of the latch and depression of the release pushbutton rotates the latch free of the latch surface to release the depressed pushbutton. A solid bar interlock is pivotally mounted on the release pushbutton, and opposite ends of the interlock extend into the paths of the pair of pushbuttons. Latched depression of one outer pushbutton draws the release pushbutton down close to the latch lever arm, whereupon little movement of the other outer pushbutton is required to operate the latch to a release condition. Simultaneous depression of both outer pushbuttons is blocked by a limit stop prior to closure of either contact set.

5 Claims, 3 Drawing Sheets

Fig. 3
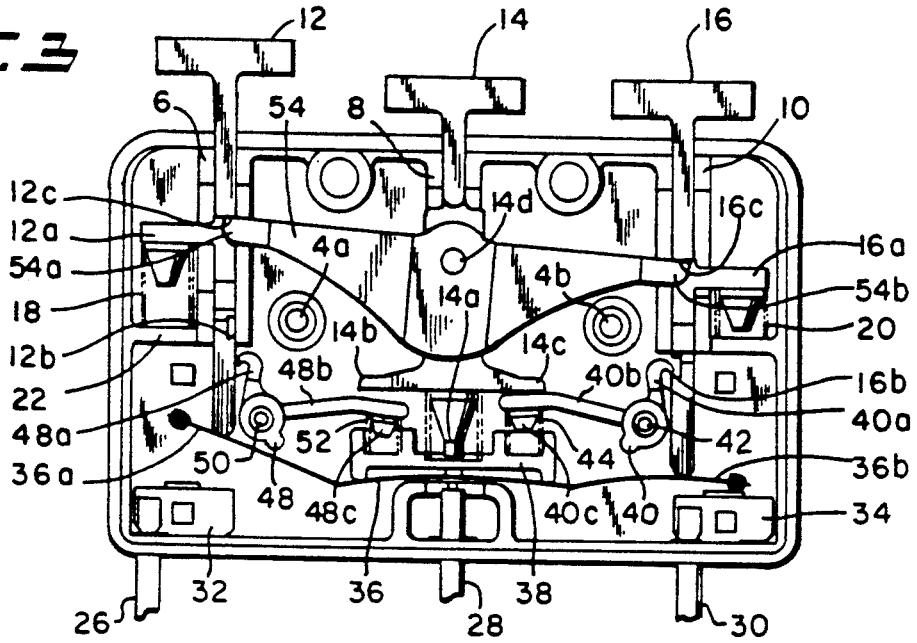
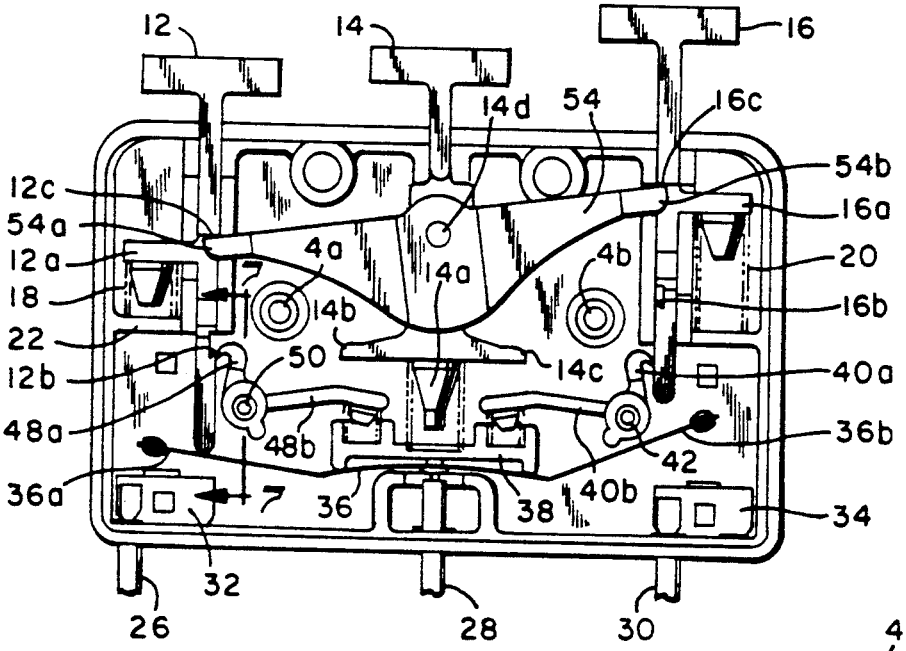
Fig. 4
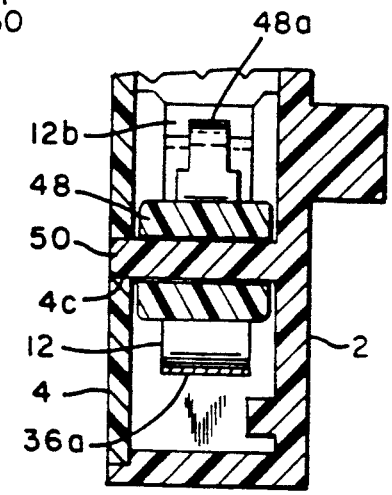
Fig. 7

PUSHBUTTON SELECTOR SWITCH

BACKGROUND OF THE INVENTION

This invention relates to pushbutton selector switches of the type wherein a pair of pushbuttons housed in a common housing are depressible to operate respective individual switch contact sets to an ON condition. An interlock is provided to prevent depression of both buttons simultaneously. A latch mechanism is provided to latch a respective pushbutton in a depressed position, thereby retaining the associated contact set in a closed position. A third pushbutton located between the aforementioned pair of pushbuttons is depressible to release the latch mechanism.

Switches of the aforementioned type have been known heretofore. The pushbutton switch shown in U.S. Pat. No. 4,392,029 issued Jul. 5, 1983 to William J. Schaad et al and in U.S. Pat. No. 4,447,688 issued May 8, 1984, a division of 4,392,029, discloses various arrangements of pushbuttons which may be interlocked or latched, some of which include a separate release button. A deflectable arm molded integral with the housing is disposed between and parallel to a pair of adjacent pushbuttons for engagement by projections on the pushbuttons to deflect the member into the path of one pushbutton upon depression of the other, thereby providing an interlock between adjacent pushbuttons, preventing both pushbuttons from being depressed at the same time. The same arm is provided with latch surfaces as are the projections on the adjacent pushbuttons whereby depression of one pushbutton causes the arm to engage that pushbutton and latch it depressed until the other pushbutton is depressed to release the latch. This switch can provide latching or interlocking between an adjacent pair of buttons only and not between a widely spaced pair of pushbuttons. The projections on the pushbuttons bear downward on the deflectable arm to place the arm under compression. The projections and the upper surfaces of the arm are angled, providing sliding cam surfaces which deflect the arm at a right angle direction change for the movement of the pushbutton.

Another switch of the aforementioned type is that shown in U.S. Pat. No. 4,544,810 issued Oct. 1, 1985 to Edmund M. Butterworth and assigned to the assignee of this invention. This switch comprises a pair of depressible outer pushbuttons alternately operable by a sliding interlock structure cammed for movement at right angles to the movement of the pushbutton by cam surfaces on the respective pushbuttons and interlock. A latch system comprises a centrally disposed release pushbutton having an actuator pivotally mounted thereon and a pair of latch members rotatably mounted in the housing on opposite sides of the actuator. The latch members engage both the actuator and a respective adjacent outer pushbutton to hold the release pushbutton depressed against a spring bias. Depression of an outer pushbutton aligns a shoulder on the outer pushbutton with a projection on an adjacent latch member, permitting the latch member to be rotated over the shoulder to a position of interference with the depressed outer pushbutton and permitting the spring to bias the release pushbutton to an extended position. Depression of the release pushbutton carries the actuator beyond a release point of the latch to reset the system. This switch utilizes a 90 degree or right angle direction change in sliding movement for the interlock member and an inter-cooperating multiple part latch system which provides interference to movement of an outer pushbutton member as opposed to true latching engagement with that member.

U.S. Pat. No. 4,701,578 issued Oct. 20, 1987 to J. J. Keranen et al and assigned to the assignee of this invention is an improvement over the Butterworth patent. The outermost pair of pushbuttons in this switch are interlocked to prevent simultaneous depression and are latched in the depressed position by a pair of sliding plates which are cammed for movement at right angles to movement of the pushbuttons by cooperating cam surfaces on the pushbuttons and the slide plates. The slide plates drive rotatably mounted contact actuators. The sliding movement and right angle camming action in this and the aforementioned switches creates high amounts of friction and potential window locking of the elements in operation.

U.S. Pat. No. 3,560,677 issued Feb. 2, 1971 and also assigned, by mesne assignments, to the assignee of this invention, discloses a pushbutton selector switch having the outer pushbuttons interlocked against simultaneous contact operation. An interlock bar is pivotally mounted on a centrally disposed OFF pushbutton. Opposite ends of the interlock bar underlie the respective outer pushbuttons. Depression of bout outer pushbuttons causes the interlock bar to depress the central pushbutton, thereby opening a set of normally closed contacts to disconnect electrical power to the switch before both outer contacts close.

While interlocking pushbutton selector switches of the aforementioned type have been useful for their intended purposes, this invention relates to improvements thereover, and more particularly to improvements over U.S. Pat. No. 4,701,578, which patent is incorporated herein by reference.

SUMMARY OF THE INVENTION

This invention provides a pushbutton selector switch wherein a pair of "ON" pushbuttons are located at the outer extremes of a common housing for closing respective sets of normally open contacts associated with the individual pushbuttons by depression of the respective pushbutton. A rotatable latch member is associated with a respective pushbutton, the latch member having a latching hook surface thereon and a radially extending lever arm. The rotatable latch member is biased into engagement with a latching surface on the associated outer pushbutton to latch it in the depressed position, holding the respective normally open contact set in an operated, closed condition. A center release button overlies the distal end of the lever arm of the rotatable latch and is depressible to rotate the latch free of the latching surface on the respective pushbutton to release that pushbutton and the respective contact set. Each outer pushbutton may be provided with a rotatable latch. The rotatable latch eliminates sliding movement between members and rotates the latch hook portion directly away from the latching surface in a direction substantially parallel to the latching surface without requiring a camming displacement between two surfaces. An interlock bar is provided on the center release button and pivotally extends to each of the outer pushbuttons. Depression of one outer pushbutton to a latched position causes partial depression of the center release pushbutton to a position wherein it is about in position to engage an activated latch. Depression of the other outer pushbutton causes further depression of the center release pushbutton to promptly operate the activated latch to a release condition to release the originally depressed outer pushbutton. Release of that pushbutton effects opening of the normally open contact set associated therewith prior to closing of the normally open contact set associated with the subsequently depressed outer pushbutton. The interlock bar also prevents either contact set from being operated if both outer pushbuttons are substantially simultaneously depressed. The invention, its advantages and features, will be more fully understood when reading the following description and claims in conjunction with the accompanying drawings.

BRIEF DESCRIPTION OF THE DRAWINGS

FIGS. 1-6 are elevational views of a pushbutton selector switch constructed in accordance with this invention showing a sequence of operating conditions of respective pushbuttons of the switch, wherein:

FIG. 1 shows the switch in an OFF position with all three pushbuttons fully extended;

FIG. 2 shows the right-hand outer pushbutton latched in a depressed position, closing an associated contact set;

FIG. 3 shows the right-hand outer pushbutton latched in a depressed position as in FIG. 2 and the left-hand outer pushbutton partially depressed causing an interlock member to partially depress the center pushbutton to a point immediately adjacent the lever arm of an operated latch;

FIG. 4 shows continued depression of the left-hand outer pushbutton to a point prior to contact closure of its associated contact set and release of the right-hand pushbutton to effect opening of the contact set associated therewith;

FIG. 5 shows full depression of the left-hand outer pushbutton to a latched state and full extension of the right-hand pushbutton;

FIG. 6 shows simultaneous depression of the left and right-hand outer pushbuttons wherein the interlock member fully depresses the center pushbutton against a bottom stop, thereby preventing simultaneous operation of the contact sets; and FIG. 7 is a cross sectional view taken along the line 7—7 in FIG. 4.

DETAILED DESCRIPTION OF THE PREFERRED EMBODIMENT

Figure 1:
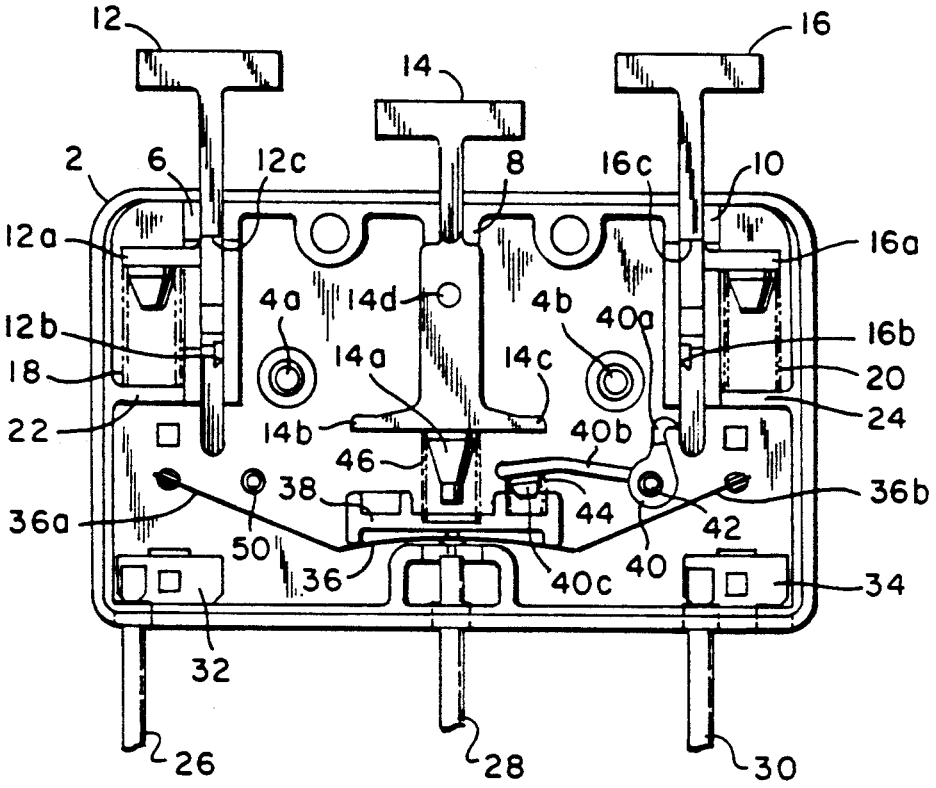

The pushbutton selector switch of this invention comprises a molded insulating case 2 and cover 4 (FIG. 7), the cover being removed in FIGS. 1-6. The case 2 comprises three pairs of spaced vertically extending ribs 6, 8 and 10 integrally molded on the inner surface adjacent the upper wall of the case. Although not shown, the inner surface of cover 4 is provided with similar pairs of spaced vertically extending ribs aligned with ribs 6, 8 and 10 in the case. Openings are provided in the upper wall of case 2 in alignment with respective channels provided by the pairs of ribs 6, 8 and 10 to serve as guides for linear reciprocal movement of pushbuttons 12, 14 and 16 mounted therein. Left and right outer pushbuttons 12 and 16 are identical but are reversely oriented within the case 2. Each has a lateral arm **12*a* and 16*a*, respectively, to receive one end of a respective helical compression spring 18 and 20. The lower ends of springs 18 and 20 rest upon shelves 22 and 24, respectively, integrally molded in the case 2. Springs 18 and 20 bias pushbuttons 12 and 16, respectively, outwardly of the housing provided by case 2 and cover 4** to an extended position relative to the housing.

The bottom wall of case 2 is provided with openings at the center and at the opposite ends for receiving wires 26, 28 and 30. Wires 26 and 30 are attached to stationary contacts 32 and 34, respectively, mounted within the case 2. Wire 28 is connected to a spring blade contact 36 mounted against the under side of a shelf 38 in case 2. Contact 36 has a pair of resilient arms **36*a* and 36*b* projecting left and right to overlie the stationary contacts 32 and 34, respectively. The distal ends of arms 36*a* and 36*b* are provided with contact tips, as are the stationary contacts 32 and 34, for cooperative engagement and good current conduction therebetween. The arms 36*a* and 36*b* lie immediately below the lower ends of outer pushbuttons 12 and 16, respectively, to be engaged by the respective pushbuttons upon depression thereof. Depression of a pushbutton 12 or 16 drives the respective movable contact arm 36*a* or 36*b* downwardly against the respective stationary contact 32 or 34. Springs 18 and 20 drive the respective pushbutton 12 or 16 to its fully extended position upon release of that pushbutton and the spring quality of the spring blade contact 36 causes the movable contact arm 36*a* or 36*b* to return to its normally open position spaced from the respective stationary contacts 32 and 34**.

A rotatable latch member 40 is shown in FIG. 1 as being rotatably mounted on a post 42 molded integrally with case 2 and extending forwardly from the inner surface of the rear wall of the case. Latch 40 has a cylindrical main body from which a goose-neck type catch **40*a* projects tangentially vertically and a lever arm 40*b* projects radially at substantially right angles with catch 40*a*. The distal end of lever arm 40*b* is provided with a downward lug 40*c* integrally molded therewith to position the upper end of a helical compression spring 44. The lower end of spring 44 sits in a pocket in the upper surface of shelf 38 of case 2. Spring 44 provides a clockwise bias to latch member 40 whereby catch 40*a* is biased against the medial surface of outer pushbutton 16. The medial surfaces of outer pushbuttons 12 and 16 are provided with latch surfaces 12*b* and 16*b*, respectively. The bias of spring 44 causes the catch 40*a* of latch 40 to automatically engage the latch surface 16*b* when pushbutton 16 is depressed sufficiently to bring the latch surface 16*b* into alignment with the catch 40*a*, at which point the lower end of pushbutton 16 forces movable contact 36*b* into circuit making engagement with stationary contact 34**.

Center pushbutton 14 is a release pushbutton for the latch 40. Pushbutton 14 is provided with a depending spring guide **14*a* which positions the upper end of a helical compression spring 46, the lower end of which is positioned within a recess in the upper surface of shelf 38 of case 2. The lower end of pushbutton 14 is provided with a pair of laterally extending arms 14*b* and 14*c* molded integrally therewith immediately above the spring guide 14*a*. Arm 14*c* overlies the distal end of lever arm 40*b* of latch 40 and, as can be seen particularly in FIG. 2, when the latch 40 is engaged with pushbutton 16, the upper end of lever arm 40*b* is disposed very close to the under side of arm 14*c*. Depression of center pushbutton 14 causes engagement of arm 14*c* with the distal end of lever arm 40*b* to rotate the latch 40 counterclockwise, thereby rotating catch 40*a* away from the medial surface of right-hand pushbutton 16 and out of latching engagement with the latch surface 16*b* to release the pushbutton 16 for return to its extended position by spring 20. As can be appreciated from the drawing, the releasing movement of catch 40***a* is generally straight away along the plane of latch surface 16*b*, thereby minimizing friction between the two members in the releasing movement.

It will be appreciated that the selector switch disclosed in FIG. 1 provides two types of pushbutton operation for outer pushbuttons 12 and 16. Depression of pushbutton 12 results in a momentary closure of movable contact arm 36*a* upon stationary contact 32, the contacts returning to the normally open position and the pushbutton returning to its extended position upon release of the operating force on pushbutton 12. Depression of pushbutton 16 causes closure of movable contact 36*b* upon stationary contact 34 and latching of the pushbutton 16 in the depressed position to maintain the contacts 36*b*-34 closed by engagement of the latch member 40 with the pushbutton 16. This engagement is maintained until such time as center release pushbutton 14 is depressed, causing lateral arm 14*c* to engage the distal end of lever arm 40*b* of latch 40 to rotate the latch out of engagement with the right-hand pushbutton 16, thereby permitting spring 20 to move the pushbutton 16 to its extended position. The selector switch shown in FIGS. 2–6 has a second latch member 48 rotatably mounted on a pin 50 integrally molded with and projecting forwardly from the back wall of case 2 to provide a latch for the left-hand outer pushbutton 12. Latch member 48 is identical to latch member 40, but reversely oriented relative to latch 40. The distal end of a lever arm 48*b* underlies the lateral arm 14*b* of release pushbutton 14. The under side of the distal end of lever arm 48*b* has a lug 48*c* which positions the upper end of a helical compression spring 52 for biasing the latch 48 counterclockwise, thereby biasing a catch 48*a* into engagement with the medial surface of left-hand pushbutton 12. The lower end of spring 52 sits within a pocket in the upper surface of shelf 38.

A mechanical interlock may also be provided in the selector switch, to prevent both outer pushbuttons 12 and 16 from being fully depressed simultaneously. Interlock member 54 is rotatably mounted on a post 14*d* projecting from a front surface of center release pushbutton 14. Interlock 54 has arms 54*a* and 54*b* extending in opposite directions from the rotational connection with release pushbutton 14, the arm 54*a* extending under a shoulder 12*c* on left-hand pushbutton 12 and the arm 54*b* extending under a similar shoulder 16*c* on the right-hand pushbutton 16.

Figure 2:
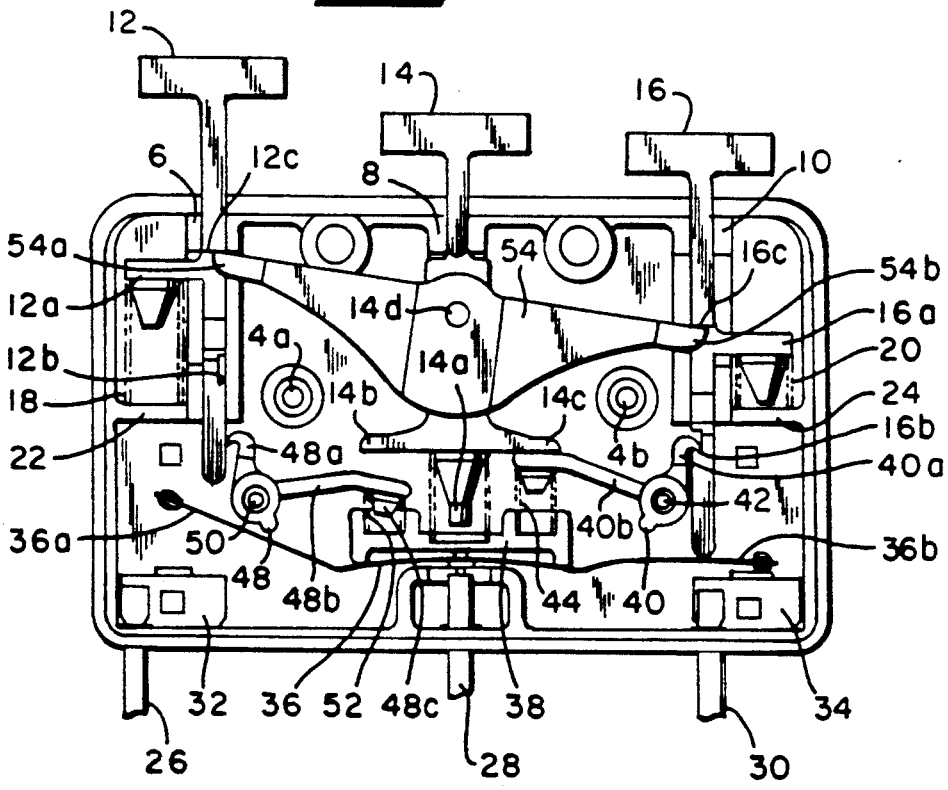

Interlock member 54 functions to not only prevent pushbuttons 12 and 16 from being fully depressed simultaneously, but it also insures that a latched outer pushbutton 12 or 16 will be released and its associated contact set 36*a*-32 or 36*b*-34 will be opened before the other contact set is closed. As seen in FIG. 2, with right-hand pushbutton 16 fully depressed and latched by latch 40, contact set 36*b*-34 is retained in a closed position. The shoulder 16*c* on pushbutton 16 engages the right-hand arm 54*b* of interlock member 54 and rotates it clockwise about the pin 14*d*. The left-hand arm 54*a* of interlock member 54 is abutting the under side of the shoulder 12*c* on left-hand pushbutton 12 which is in its fully extended position. Therefore, depression of right-hand pushbutton 16 operates on interlock member 54 to cause it to pivot about its left-hand end 54*a* and its engagement with the shoulder 12*c* on left-hand pushbutton 12, which movement drives the center of interlock member 54 downward. Thus interlock member 54 through its connection with pin 14*d* drives release pushbutton 14 slightly downward when an outer pushbutton such as 16 is moved to the latched position.

Referring to FIG. 3, the right-hand pushbutton 16 remains latched in its fully depressed position, and left-hand pushbutton 12 is shown in a partially depressed position where an attempt is being made to depress the left-hand pushbutton 12 while the right-hand pushbutton 16 is latched down. It can be seen that this partial depression of left-hand pushbutton 12 has further depressed center release pushbutton 14 so as to cause the right-hand lateral arm 14*c* to bear down upon the distal end of lever arm 40*b* of the latch 40, thereby rotating the latch 40 counterclockwise and the catch 40*a* substantially in a direction parallel to the latch surface 16*b* for minimum friction between the latch 40 and the pushbutton 16. In FIG. 3, the latch 40 has almost released the right-hand pushbutton 16 at the point of movement of left-hand pushbutton 12 whereat the lower end of the left-hand pushbutton 12 contacts the left-hand movable contact arm 36*a*. It is noted that the lower end of spring guide 14*a* on release pushbutton 14 has not yet bottomed against the upper surface of shelf 38 at this position.

Figure 5:
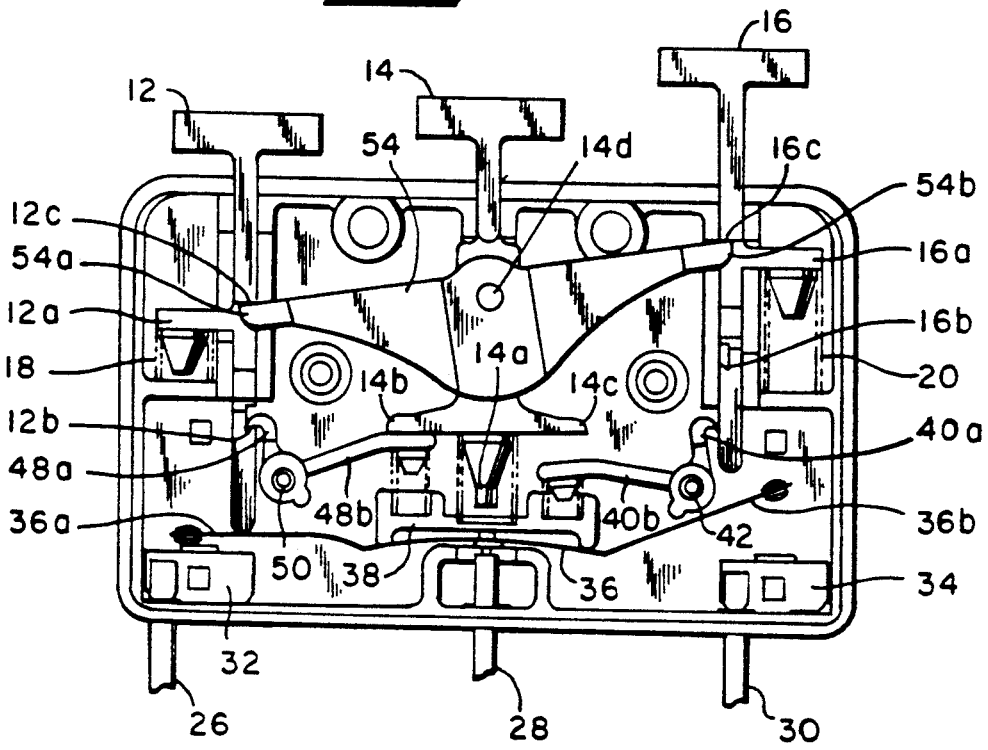

FIG. 4 shows the selector switch mechanism in the next increment of depressive movement of left-hand pushbutton 12 wherein latch 40 has released right-hand pushbutton 16 and the latter has moved to its fully extended position under the bias of spring 20. It will be noted that at this position, the left-hand pushbutton 12 has not yet been fully depressed and thus contact set 36*a*-32 has not been closed. Additionally, latch 48 has not engaged with the latch surface 12*b* on the left-hand pushbutton 12. The actual latching of these two members is shown in FIG. 5 wherein the left-hand pushbutton 12 is shown fully depressed with the contact set 36*a*-32 held in closed condition by the latch 48 engaging the pushbutton 12. Operation reverse to that hereinbefore described occurs when the left-hand pushbutton 12 is latched down as in FIG. 5 and the right-hand pushbutton 16 is depressed. Of course, depression of release pushbutton 14 independently of the outer two pushbuttons will cause release of either latched outer pushbutton and return to a normally open status of the associated stationary contact.

Figure 6:
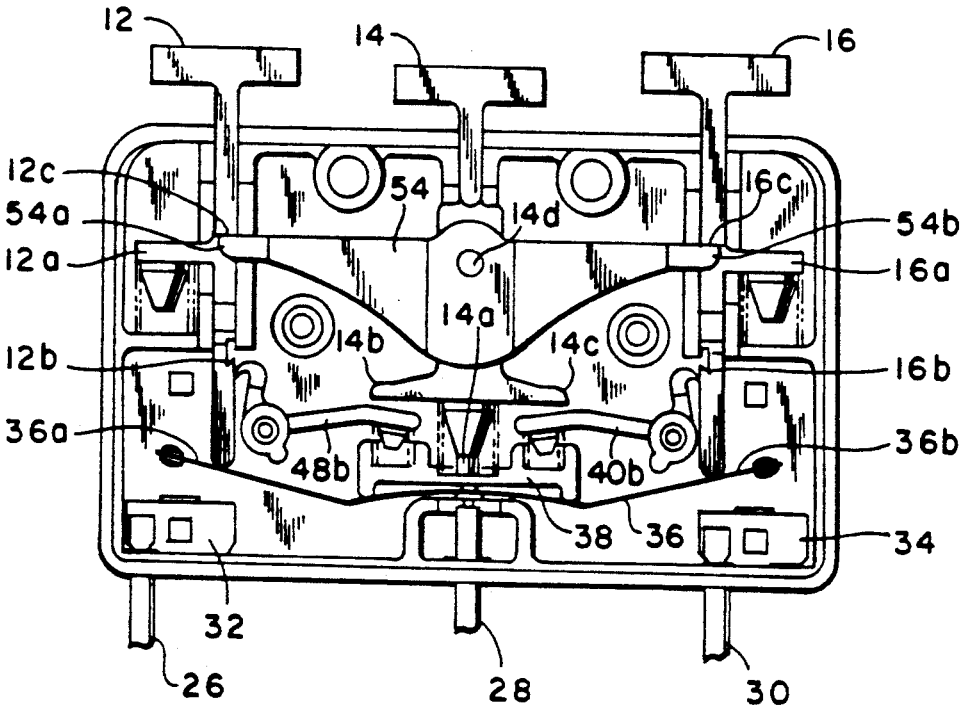

FIG. 6 depicts both outer pushbuttons 12 and 16 being depressed simultaneously wherein both shoulders 12*c* and 16*c* of pushbuttons 12 and 16 bear upon the respective outer ends 54*a* and 54*b* of interlock member 54 pivotally attached to the release pushbutton 14. When the lower end of spring guide 14*a* bottoms against the upper surface of shelf 38, further depression of center pushbutton 14 is prohibited. This blocks further simultaneous depression of outer pushbuttons 12 and 16.

With reference to FIG. 7, cover 4 is attached to the case 2 by fasteners (not shown) which extend through holes 4*a* and 4*b* in the rear wall of case 2 and through aligned holes (not shown) in the cover. Reference may be had to U.S. Pat. No. 4,701,578 for a more complete explanation of the attachment of cover 4 to case 2. Cover 4 is also provided with holes 4*c* (FIG. 7) which receive the ends of posts 50 and 40 to support the distal end of the respective post upon which the respective latches 48 and 40 are mounted.

The foregoing has described a pushbutton selector switch having an interlock and latch mechanism constructed according to the best mode contemplated of carrying out our invention. It is to be understood that the invention is susceptible of various modifications without departing from the scope of the appended claims.

We claim:

1. A pushbutton selector switch comprising:

an insulating switch housing;

a pair of normally open contact sets in said housing;

a pair of pushbuttons mounted for linear reciprocal movement in said housing, each pushbutton individually depressible to operate a respective one of said pair of normally open contact sets to a closed condition;

at least one latch member mounted for rotational movement in said housing and biased against a respective one of said pair of pushbuttons, said latch member being operable to latch said respective one of said pair of pushbuttons in a depressed position to retain said respective contact set closed, said latch member having a lever arm projecting radially therefrom; and a release pushbutton mounted for linear reciprocal movement in said housing intermediate said pair of pushbuttons depressible to engage a distal end of said lever arm and rotate said latch member to release said respective one of said pair of pushbuttons.

2. The pushbutton selector switch defined in claim 1 further comprising:

a rigid interlock member rotatably mounted on said release pushbutton, opposite ends of said interlock member extending under portions of said pair of pushbuttons, wherein:

said respective one of said pair of pushbuttons retained in said depressed position by said latch member effects partial depression of said release pushbutton through said interlock member, said partial depression being insufficient to effect rotation of said latch member and release of said respective one of said pair of pushbuttons, and partial depression of the other of said pair of pushbuttons effects continued depression of said release pushbutton though said interlock member to engage a distal end of said lever arm and rotate said latch member to release said respective one of said pair of pushbuttons.

3. The pushbutton selector switch defined in claim 2 wherein said partial depression of said other of said pair of pushbuttons is insufficient to operate a respective one of said normally open contact sets.

4. The pushbutton selector switch defined in claim 3 wherein:

said release pushbutton comprises a mechanical stop limiting depression of said release pushbutton; and simultaneous depression of said pair of pushbuttons depresses said release pushbutton through said interlock member to engage said mechanical stop, depression of said pair of pushbuttons being insufficient to operate either of said pair of contact sets to a closed condition.

5. The pushbutton selector switch defined in claim 4 comprising a second latch member mounted for rotational movement in said housing and biased against said other of said pair of pushbuttons, said second latch member being operable to latch said other of said pair of pushbuttons in a depressed position to retain a respective one of said normally open contact sets in a closed condition, said second latch member having a lever arm projecting radially therefrom under said release pushbutton for engagement thereby to effect rotation of said second lever and release of said other of said pair of pushbuttons upon depression of said release pushbutton.

* * * * *